US005556342A

United States Patent [19]

Berberian

[11] Patent Number: 5,556,342

[45] Date of Patent: Sep. 17, 1996

[54] BALL HAVING SURFACE INDENTATIONS FOR GAMES OF BOWLS AND PROCESSES FOR OBTAINING SUCH A BALL

[76] Inventor: Vartan Berberian, 16, rue Michel-le-Comie, 75003 Paris, France

[21] Appl. No.: 347,369

[22] PCT Filed: Jun. 10, 1993

[86] PCT No.: PCT/FR93/00552

§ 371 Date: Feb. 21, 1995

§ 102(e) Date: Feb. 21, 1995

[87] PCT Pub. No.: WO93/25284

PCT Pub. Date: Dec. 23, 1993

[30] Foreign Application Priority Data

Jun. 10, 1992 [FR] France ..... 92 06969

[51] Int. Cl.[6] ..... A63B 37/14; A63B 39/08

[52] U.S. Cl. ..... 473/125; 273/58 B; 273/58 K; 473/378

[58] Field of Search ..... 473/125; 273/58 R, 273/62, 217, 232, 233, 58 A, 58 B, 58 BA, 58 K, 118 R

[56] References Cited

U.S. PATENT DOCUMENTS

| | | | |
|---|---|---|---|
| 426,120 | 4/1890 | Furman | 273/58 B |
| 1,855,448 | 4/1932 | Hazeltine | 273/217 |
| 4,248,424 | 2/1981 | Judkins | 273/58 K |

FOREIGN PATENT DOCUMENTS

| | | |
|---|---|---|
| 2638375 | 5/1990 | France . |
| 2668074 | 4/1992 | France . |
| 2671019 | 7/1992 | France . |

*Primary Examiner*—William M. Pierce
*Attorney, Agent, or Firm*—Pollock, Vande Sande & Priddy

[57] ABSTRACT

Bowl for games such as petanque, including an outer surface (2) composed of a base surface (4) with prominent patterns (3, 103), regularly distributed on at least 90% of the total base surface (4). The total surface occupied by said patterns (3, 103) on the base surface (4) represents at least 30% of the latter (4). The patterns (3, 103) are bordered by substantially cylindrical surfaces (4), with their generatrices (6) being almost parallel, within a small angle, known as the offset angle ($D_1$).

20 Claims, 2 Drawing Sheets

BALL HAVING SURFACE INDENTATIONS FOR GAMES OF BOWLS AND PROCESSES FOR OBTAINING SUCH A BALL

The subject of the present invention is a bowl for games of bowls, which can be used for the games of bowls, in which, especially, a bowl is rolled along the ground, for example the Provencal bowl, the Lyons bowl, the Italian bowl and, more particularly, the pétanque bowl; the subject of the invention is also processes for obtaining such a bowl.

It is known that, in the aforementioned games of bowls, the player seeks a bowl which has as small as possible a rebound when it strikes another bowl and which, also, is barely deflected when it touches the ground and when it follows as best it can the trajectory that he desires; he also wishes for it not to be deflected by asperities on the ground when it rolls along it, nor braked when it rolls along the ground; the player also wishes for the bowl to be able to be well gripped in the hand and to be pleasant to touch.

In the case of the game of pétanque, the "pointer", who seeks to place his bowl as close as possible to the "jack", desires to control the trajectory of his bowl and wishes for his bowl not to be deflected on impact with the ground, or by an asperity on the ground, when it rolls along it. The "shooter" wishes for his bowl to recoil as little as possible under the effect of the shock when his bowl strikes the bowl of an opponent, so as to make what is called "a strike dead on the spot".

Currently in pétanque, the "pointer" and the "shooter" use different hollow metal bowls: the "pointer" uses hard bowls of relatively small diameter, often equipped on their surface with groups of circular, parallel or orthogonal grooves which enable the bowl to brake when it rolls along the ground; the "shooter" generally uses bowls of lower hardness, called "softs", and of larger diameter so as to diminish the rebound phenomenon on impact of his bowl with another bowl; however, in practice, it is difficult to obtain bowls having a sufficiently low rebound, and giving satisfaction, since such bowls have too low a hardness and are, after a short period of use, marked and deformed, which leads to them having a random behavior. It is therefore particularly advantageous to seek to produce bowls having a small rebound, to within one diameter, which can be used both by the "shooter" and by the "pointer". The jack is generally formed by a solid bowl made of boxwood or other wood or made of a plastic of the same density, and the surface of the bowl is smooth. On impact with a bowl, the "jack" tends to rebound and to roll along the ground in a random fashion since it is not braked.

In order to limit the rebound phenomenon of a hollow metal pétanque bowl, it was proposed in FR-A-2,638,375 to machine, on the internal surface of the two hemispherical shells forming the bowl after assembly, serrations constituting either a system of circles which are parallel to each other or two systems of circles which are orthogonal at the points of intersection, in a manner similar to the lines of latitude and longitude on the Earth. However, this mode of construction does not enable the rebound to be limited in a sufficiently homogeneous manner. In fact, since the thickness of the wall is reduced in the region of the serrations, the rebound is limited when the impact takes place in this region. However, zones remain where the thickness of the bowl is not altered and there is no obstacle to propagation of the shock wave in the material of which the bowl is composed; the rebound therefore remains significant and the behavior of the bowl to the shock remains random.

Moreover, it is known to arrange serrations on the external surface of the bowl in order to brake it and to increase its adhesion to the ground. However, serrations arranged on the bowl run the risk of permitting penetration of an asperity from the pitch into the said serration and, consequently, an unexpected deflection of the bowl.

In French Patent Applications 90/13030 filed on 22nd Oct. 1990 and 90/16538 filed on 31st Dec. 1990, the applicant has proposed a bowl, in particular a hollow metal bowl, which includes, possibly, indentation patterns on its internal face and indentation patterns and/or relief patterns on its external face, these being uniformly distributed. This bowl enables the problem of the rebound to be solved in a satisfactory manner; it can be used both by the "pointer" and the "shooter" and it is pleasant to hold in the hand. In addition, the rail effect due to the serrations completely disappears, thus preventing any unpredictable deflection.

However, the manufacture of this type of bowl has certain drawbacks. Hemispheres are difficult to produce from preformed blanks, possibly coming from billets, which include indentation patterns or relief patterns on their internal or external faces and, consequently, the cost of manufacture is high. In addition, the zones of smaller thickness of the bowl become relatively brittle due to the operation.

The subject of the present invention is a bowl insensitive to the rail effect, the behavior of which is satisfactory with regard to the problem of the rebound, which can be used, in the game of pétanque, both by the "pointer" and the "shooter", which is not brittle, given the repeated shocks which it is required to receive, and which is obtained by a manufacturing process having a competitive production cost.

According to the present invention, a bowl, for games of bowls, especially for pétanque, which includes, on its external face, relief patterns, with respect to a base surface, uniformly distributed over at least 90% of the totality of said base surface, the surface area occupied by all the relief patterns on the base surface representing at least 30% of said base surface, is characterized in that said relief patterns are bordered by substantially cylindrical surfaces whose generatrices are parallel to within a small angle, called the angle of draft.

Thus, also according to the present invention, such a bowl is produced by forging, closed-die forging or casting, indentation patterns or relief patterns on the external and/or internal faces of preformed hemispheres, along substantially parallel directions, to within the angles of draft, in order to make it easier to disengage the tools, and therefore the workpiece.

In fact, in order to make it easier to disengage the workpieces, the surfaces bordering said patterns are virtually cylindrical, in fact slightly conical because of the angle of draft.

According to a first embodiment of the invention, each relief pattern on the external face of the bowl occupies from 0.01% of 0.5% of the base surface, the surface area of all of the relief patterns representing at least 70% of said external face, all the patterns including a culminating zone which is internally tangential to one and the same spherical envelope or forming part of said envelope, the radius of curvature of said culminating zone being between 1 mm and the diameter of said spherical envelope, and the culminating zones being located above the base surface at a height of between 1% and 5% of the diameter of said spherical envelope.

The minimum distance, measured along the base surface, between two relief patterns is, advantageously, between 0% and 5% of the diameter of the spherical envelope. Thus, the base surfaces of two adjacent patterns may have a common line, be tangential or be spaced apart.

Provision may also be made, in order to permit identification of the bowl, to arrange, on the culminating zone of at least one part of the relief patterns, small cavities in the form of a concave spherical cap; these cavities have, for example, a maximum diameter of 2 mm and a depth of from 0.5 to 2 mm for a pattern whose culminating zone is a spherical cap having a diameter of 6 mm; these small cavities may be filled with a colored resin.

According to a second embodiment of the invention, all the relief patterns are connected to each other, revealing indentation patterns separated from each other, in the region of the base surface, said indentation patterns each occupying from 0.01% of 0.5% of the base surface of the bowl, the surface area of all the indentation patterns representing from 10 to 70% of said external face.

It may advantageously be provided that the indentation patterns on the external surface of a bowl according to the invention have a depth of between 0.5 and 4% of the outside diameter of the bowl.

In order to distinguish the bowl, it may be colored by copper plating, brass coating, zinc plating, chrome plating or the like; subsequent polishing, carried out in manufacture or due to the wear of the bowl, of the external face of the bowl leaves, due to this treatment, the color to remain only in the indentations on the external face, the starting material of the bowl appearing, after polishing, only on the relief patterns. This gives a very esthetic appearance to the bowl and, of course, it is possible to divide up said external face into areas of different color, it being possible for each hemisphere especially to be of different color. It is also possible to color the indentations by depositing a colored plastic, for example an epoxy resin, which is not flush with the external face.

It has been observed that, by virtue of the presence of the indentation patterns or relief patterns arranged on the external surface of the bowl, said bowl is easier and more comfortable to hold in the hand. In addition, the bowl, when it rolls along the ground, is braked by the external indentation patterns or relief patterns which interact with the asperities on the ground, in order to slow down and to stop the bowl, and which thus promote the adhesion of said bowl to the ground. Furthermore, the bowl maintains the desired direction more easily since, contrary to the continuous circular grooves of the prior art, the indentation patterns or relief patterns do not define continuous lines which promote the rail effect. In addition, on rebounding, the bowl according to the invention is virtually never abnormally deflected because of the uniform distribution of the indentation patterns or relief patterns and because of their small individual surface area.

The bowl may be solid. This is particularly the case for the "jack". In this case, it is preferably obtained by the molding of a plastic having a density close to that of wood.

According to one preferred embodiment of the invention, the bowl is hollow and includes, on its internal face, indentation patterns or relief patterns bordered by substantially cylindrical surfaces whose generatrices are parallel.

Preferably, each relief pattern or indentation pattern on the internal face projects, along said parallel generatrices, at least partially but preferably entirely, over the zone occupied on the external face respectively by an indentation pattern or relief pattern.

According to the preferred embodiment in which each pattern on the internal face projects, along the parallel generatrices, integrally from the zone occupied on the external surface by a pattern, the rebound is greatly limited and it is virtually homogeneous. In fact, in this case, the thickness of the wall is barely variable and it undulates as it were about a mean spherical surface. Consequently, at the moment of the shock of the bowl on another bowl or on the ground, there is, in addition to the radial deformation, a deformation in a plane tangential to the mean surface which enables the elastic rebound to be limited. Since the thickness of the wall barely varies, the limited elastic rebound barely varies from one point of shock on the bowl to another. The limited elastic rebound is therefore virtually constant from one point on the bowl to another.

The indentation patterns or relief patterns represent, on the external or internal face of the bowl, a geometrical figure which is preferably symmetrical with respect to at least one axis and which forms, for example, a square, a rectangle, a rhombus, an equilateral triangle, a hexagon, a circle, an ellipse, a cross or a star. The figures may, however, be unsymmetrical figures, such as a non-equilateral triangle, a semicircle and, possibly a symbol such as those used on playing cards (club, heart, spade, diamond).

The base surface is preferably spherical, advantageously concentric with the spherical envelope.

According to another embodiment, the patterns on the external face of the bowl have a trapezoidal shape and are distributed over the base surface along lines of longitude and latitude of the bowl, leaving spaces of constant width between each trapezoidally-shaped pattern.

All the relief patterns or indentation patterns preferably have, on the external face, the same shape and the same size on one and the same bowl, that is to say that the sections of the cylindrical surfaces through the external face of the bowl are substantially equal. However, provision may be made for certain relief patterns to have a different shape, and/or more particularly a different size, so as to permit identification of the bowl, and by making groupings of patterns, for example.

According to a preferred embodiment of the invention, the cylindrical surface which defines the patterns on the internal and/or external face of the bowl has a cross section which decreases from the pole of the hemispheres constituting the bowl to their equatorial zone. In particular, in order to obtain patterns of the same surface area on the external face of the bowl, said patterns are bordered by substantially cylindrical surfaces whose outline is an ellipse, said ellipse including a major axis equal to the diameter of the circle at the top of the hemisphere and a minor axis whose projection, along a generatrix of the cylindrical surface on the external face, is equal to the diameter of said circle at the top of the hemisphere.

Preferably, there are the same number of patterns on the external face as on the internal face.

According to the invention, the external face, and possibly the internal face, of the bowl has a zone devoid of patterns, it being possible for this zone to represent up to 10% of the base surface. This zone is, most often, an annular zone located between two planes parallel to the equatorial plane; this equatorial annular zone generally corresponds, when the bowl is hollow, to the welding zone of the two hemispherical shells joined together to form the bowl. This zone may be used to reveal, on the outside face of the bowl, characteristic marks or drawings such as logos, initials, numbers, weight, series or name of the player.

The pétanque bowls are generally, in a known manner, hollow metal bowls having a weight of between approximately 700 g and 800 g, a diameter of between 70 mm and 80 mm and a thickness of from 5 mm to 7 mm. The indentation patterns on a bowl according to the invention generally have, in this case, a depth of between approximately 0.5 and 2 mm. The pétanque bowls are, most often, manufactured from carbon steel or stainless steel; the bowls intended for games on smooth or carefully prepared pitches may also be made from brass or aluminum bronze.

The presence of the relief patterns or indentation patterns on the external face of the bowl enables the bowl to bite into the ground and enables the "pointer" to control the trajectory of his bowl, in particular when he has given his bowl a spin.

It will also be noted that the relief patterns constitute, quite naturally, indicators of wear of the bowl. Furthermore, the presence of indentations and protruberances prevents the propagation of the shock wave on impact of the bowl, this increasing the strength of the bowl and, in particular, limits the embrittlement of the welds of the two hemispheres and even permits application of cold welds, which are simpler to implement, such as the special adhesives of the type marketed under the ARALDITE trademark.

The inside of the bowl may especially include a single indentation or protruberance, a distribution of indentations or protruberances in the form of a honeycomb, or partitioning in the form of indentations or in relief form.

In order to decrease, if necessary, the imbalance of the bowl, the poles and the equatorial zone may include bosses on the internal face of the hemispheres.

When the two hemispheres are joined together by welding, a bevelled chamfer, provided in the region of the equator, makes this operation easier. Preferably, in order to center the two hemispheres, an annular central slot is made in the thickness of the wall, of the two hemispheres, located in the equatorial plane, so as to house therein a single ring connecting the two hemispheres. This ring may have any section, square, circular or rectangular. The annular slot may be continuous, but also discontinuous and made up by circumferentially aligned sectors made in radial dividers partitioning the inside face of the bowl in order to define indentation patterns therein.

In order to understand the subject of the invention better, a description will be given below, purely by way of illustration and implying no limitation, of an embodiment depicted in the appended drawing.

Figure 1:
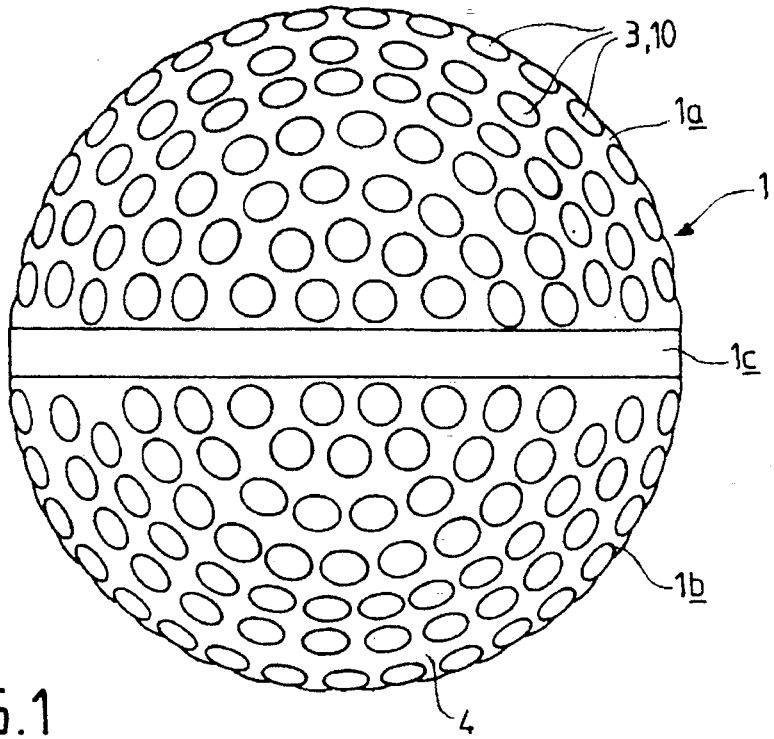
FIG. 1 is a front view of a bowl according to the invention.
Figure 2:
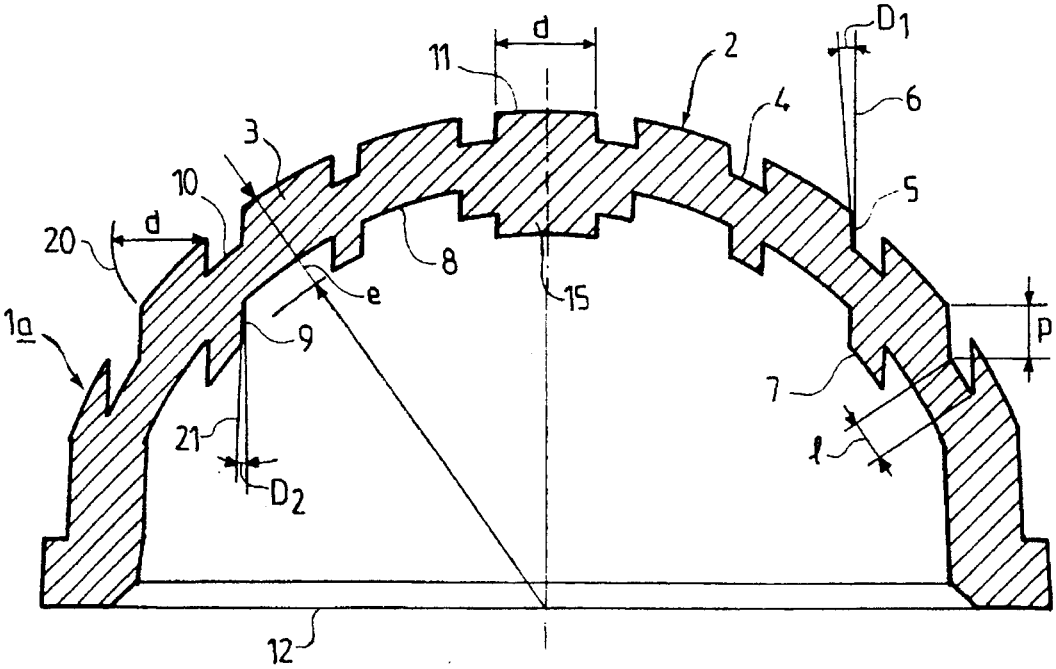
FIG. 2 is an enlarged partial sectional view of the bowl of FIG. 1.

FIGS. 1 and 2 depict a hollow metal bowl according to the invention, made from stainless steel and having a weight of 700 g; it is designated in its entirety by 1. It should be pointed out that the sectional representation of FIG. 2 is a false diametral section, the adjacent and successive patterns never being centered on one and the same meridional circle; FIG. 2 has thus been depicted in order to make it easier to understand. The bowl 1 consists of two hemispherical shells 1*a* and 1*b* joined together by welding in an equatorial plane, the welding zone 1*c* constituting an annular zone devoid of patterns, representing 6% of the base surface of the bowl.

Each hemispherical shell 1*a* and 1*b* is bounded on the outside by a spherical external face 2 whose diameter is the diameter of the bowl, equal to 75 mm, this spherical external face enveloping patterns 3 which are in relief with respect to a spherical surface 4 called the base surface whose diameter is less than that of the external face 2. These independent relief patterns 3 are uniformly distributed over the base surface 4; the minimum distance l between two patterns on the base surface 2 [sic] is 1.5 mm; the height p of the relief pattern 3, above the base surface 4, is 2 mm; the diameter d of the top circular pattern 11 is 6.5 mm; each pattern is bordered laterally by a cylindrical surface 5.

Each hemispherical shell 1*a* and 1*b* is bounded on the inside by a spherical internal face 7, concentric with the external face 2; the difference between the radius of the external face 2 and the radius of the internal face 7 defines the thickness e of the bowl, in this case 7 mm. The internal face 7 envelops patterns 8, in the form of indentations, which project, perpendicularly to the equatorial plane, integrally and in line with the zone occupied by each relief pattern 3, from the base surface 4. Each pattern is bordered laterally by a cylindrical surface and the diameter of the circular cross section of the cylinder bordering the pattern 8 is 5 mm; the depth of the indentation pattern 8, measured in the same way as the height p of the relief pattern 3, is equal to this height, namely 2 mm. In total, the bowl possesses 240 patterns over its external face 2 and over its internal face 7. The indentations have peaks and valleys, wherein the peaks are defined by the external face of the bowl and the valleys between indentations are defined by the base surface of the bowl.

In FIG. 2, it may be seen that the relief patterns 3 on the external face 2 and the indentation patterns 8 on the internal face 7 are bordered by cylindrical surfaces 5, 9 whose generatrices 6 and 21 are parallel and perpendicular to the equatorial plane 12 of the hemisphere 1*a*, to within an angle of draft, $D_1$ for the relief patterns 3 and $D_2$ for the indentation patterns 8. Each indentation is substantially cylindrical about an axis, wherein the axis of each indentation being substantially parallel to each other within a small offset angle $D_1$.

All the relief patterns 3 have the shape of a circle and the same diameter d on the external face 2 of the bowl 1. This result is obtained by the spherical surface of the external face 2 being intersected by cylindrical surfaces 5 of elliptical outline in cross section, the major axis of the ellipse being equal to d and the minor axis having, whatever the position of the pattern on the external spherical face 2, a projection, along the generatrices 6, equal to d on the face 2; this is shown pictorially by the circular arc 20 in FIG. 2. In order to decrease, if necessary, the imbalance of the bowl, the poles 11 and the equatorial zone may include bosses 15 on the internal face (7) of the hemispheres 1*a*, 1*b*.

Figure 3:
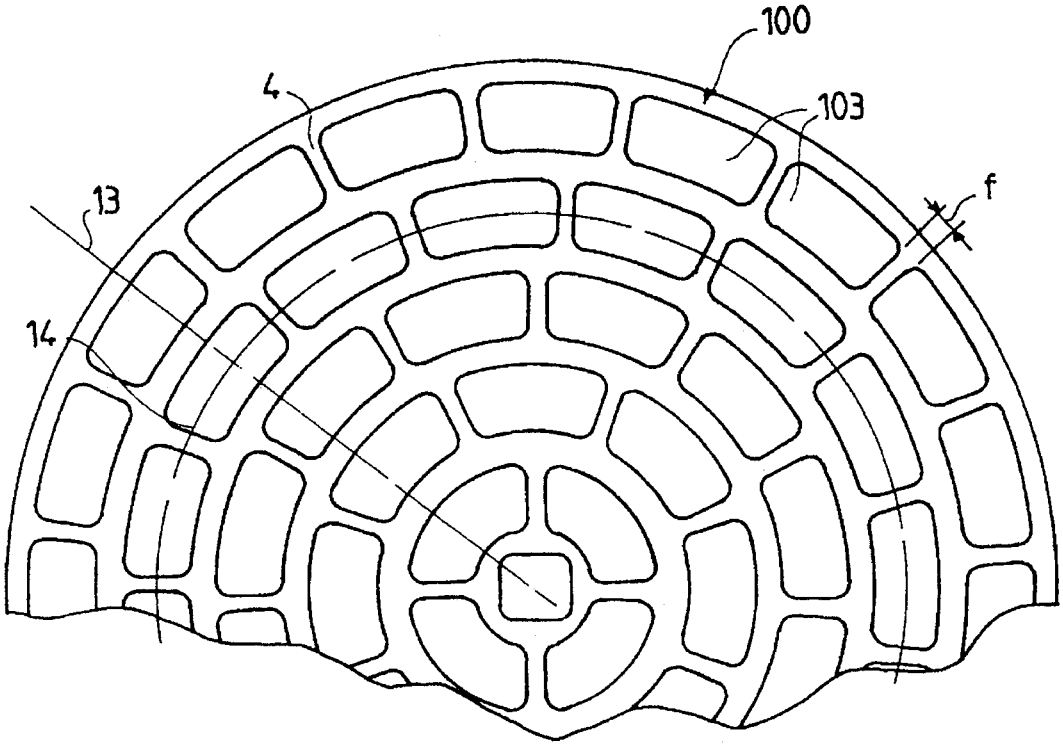
FIG. 3 is a view from above a bowl according to another embodiment of the invention.

The bowl depicted in a view from above, in FIG. 3, is designated in its entirety by 100: the elements which differ from the first embodiment are referenced by means of the same references as those given in FIGS. 1 and 2, but increased by 100. This bowl includes trapezoidally-shaped relief patterns 103 which are distributed over the base surface 4 along lines of latitude 14 and along lines of longitude 13, but staggered between one line of latitude and another. The space f separating each pattern 103 has a constant width.

Figure 4:
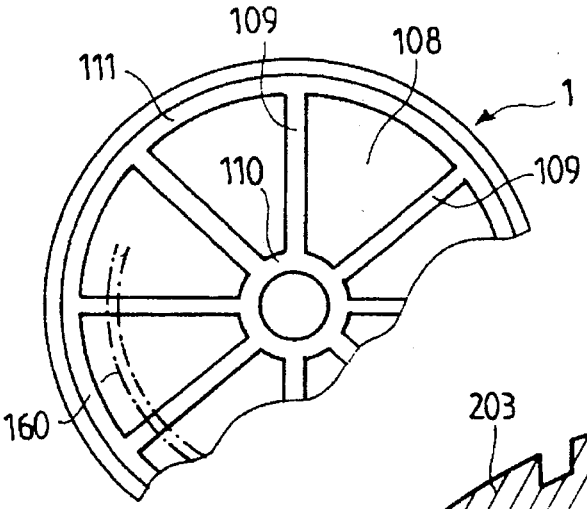
FIG. 4 is a view from below of the internal face of a hemisphere according to another embodiment.

FIG. 4 depicts another embodiment of an internal face of a bowl according to the invention; the inside face depicted in FIG. 4 shows indentation patterns 108 partitioned by radial dividers 109 connected at their ends by circular zones 110, 111; such an arrangement also ensures good damping of the shock wave upon an impact.

Figure 5:
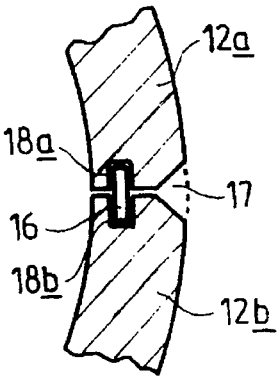
FIG. 5 is a partial sectional view in a diametral plane of an alternative form of a bowl.

FIG. 5 is a partial sectional view of the annular welding zone, devoid of patterns, of the two hemispherical half-shells 1*a* and 1*b* of a bowl according to the invention; the two equatorial half-zones 15*a* and 15*b* are given a bevelled chamfer defining a space 17 intended to receive the weld when welding the two hemispheres. An annular central slot

18*a*, 18*b* is hollowed out in the wall of the two hemispheres, in the equatorial plane, so as to receive a ring 16, in order to make it easier to center the two hemispheres relative to each other: in the example depicted, the section of the ring 16 and of the slots 18*a* and 18*b* is rectangular; this section could be circular, the ring in this case being a toroidal ring; in an alternative form, not depicted, the annular slot is discontinuous and made up by sectors made in the radial dividers 109, the ring having a diameter less than or equal to that of the internal face of the bowl, as suggested by the dotted lines 160 in FIG. 4. It has been observed that the presence of such a ring, made of a material different from that of which the bowl is composed, advantageously contributes to the breaking of the shock wave upon an impact on the bowl.

Figure 6:
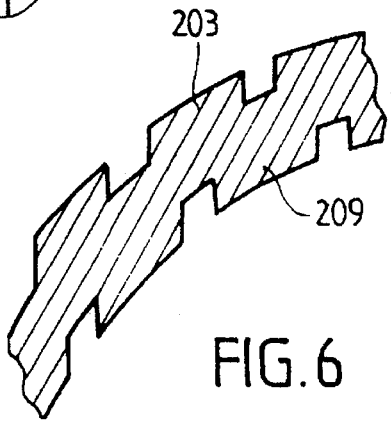
FIG. 6 is a partial sectional view of another alternative form.

FIG. 6 shows, in partial section, an alternative form of a bowl whose external face has protruberances 203, similar to the protruberances 3 or 103 of FIGS. 2 or 3, while the internal face also includes protruberances 209 which may be identical to the protruberances 203 or different; the protruberances 209 are not in line with the protruberances 203, but offset, as shown in FIG. 6.

All the alternative forms described hereinabove have the same advantages. It is observed that such a bowl is very pleasant to hold in the hand and any slippage at the time of throwing it is prevented; the bowl behaves satisfactorily for a "pointer": it rolls without random deflection with respect to the trajectory desired by the player; the bowl also behaves satisfactorily for a "shooter": it strikes a target bowl without appreciable random deflection on rebound and the said rebound is markedly smaller compared to bowls of the prior art, this facilitating a "strike dead on the spot" in which the thrown bowl, without rebound, takes the place of the target bowl struck.

Of course, it would have been possible to replace all the relief patterns 3, 103 by indentation patterns.

These bowls have been manufactured from circular blanks having a diameter of 120 mm, which represent the opened-out surface of a hemisphere. The blanks are converted into hemispheres by closed-die forging, this enabling indentation patterns or relief patterns to be obtained on the internal and/or external face of the bowl. Next, the two hemispheres are welded and the ball obtained is machined in order to remove, in particular, the irregularities in the equatorial zone where the weld bead is located and, if so desired, to give the bowl a color effect.

In the foregoing, the two hemispheres have been welded in order to produce a spherical bowl; of course, the two hemispheres could be bonded by screwing one hemisphere onto the other.

Excellent results have also been obtained by casting the hemispheres in a single operation.

In an alternative form, not depicted, when the metal used for manufacturing the bowl has a density allowing this, the bowl is solid and its external face is similar to the external faces of the hollow bowls described previously.

We claim:

1. Bowl for games of bowls, comprising an external face (2) a base surface (4) and a relief pattern of a plurality of indentations (3, 103) having peaks and valleys wherein said peaks of said indentations are defined by said external face, and said valleys between said indentations are defined by said base surface, and wherein said relief pattern is uniformly distributed over at least 90% of said base surface (4) and wherein said indentations occupy a surface area that is at least 30% of said base surface (4); and wherein each indentation is substantially cylindrical about an axis, wherein the axis of each indentation being substantially parallel to each other within a small offset angle ($D_1$), for facilitating disengaging a tool during production of said bowl by forging, closed-die forging or casting.

2. Bowl according to claim 1, wherein each indentation occupies from 0.01% to 0.5% of said base surface, and wherein said relief pattern has a surface area that represents at least 70% of said external face.

3. Bowl according to claim 2, wherein said bowl is hollow and comprises an internal face (7), wherein said internal face has indentation patterns (8, 108), wherein each indentation pattern is substantially cylindrical about an axis, and wherein the axis of each indentation is substantially parallel to each other within a small offset angle, ($D_2$).

4. Bowl according to claim 2 comprising hemispheres (1*a*, 1*b*), having a pole (11) and comprising an equatorial plane (12), wherein the patterns (3, 103, 8) on said internal face (7) or said external face (2) of said bowl (1) or both have a cross section which decreases from said pole (11) of said hemispheres (1*a*, 1*b*) of said bowl (1) to said equatorial plane (12) of said bowl.

5. Bowl according to claim 1, wherein all said indentations are connected to each other, revealing indentation patterns separated from each other, in the region of said base surface, said indentation patterns occupying from 0.01% to 0.5% of said base surface, and wherein all the indentation patterns have a surface that represents from 10 to 70% of said external face.

6. Bowl according to claim 5, wherein said bowl is hollow and comprises an internal face (7), wherein said internal face has indentation patterns (8, 108), wherein each indentation pattern is substantially cylindrical about an axis, and wherein the axis of each indentation is substantially parallel to each other within a small offset angle, ($D_2$).

7. Bowl according to claim 5 comprising hemispheres (1*a*, 1*b*) having a pole (11) and comprising an equatorial plane (12), wherein the patterns (3, 103, 8) on said internal face (7) or said external face (2) of said bowl (1) or both have a cross section which decreases from said pole (11) of said hemispheres (1*a*, 1*b*) of said bowl (1) to said equatorial plane (12) of said bowl.

8. Bowl according to claim 5, wherein the indentations on said external face (2) of said bowl (1) have a trapezoidal shape and are distributed over said base surface (4) along lines of longitude (13) and lines of latitude (14) of the bowl (1), leaving spaces of constant width (f) between each trapezoidally-shaped indentation.

9. Bowl according to claim 1, wherein said bowl is hollow and comprises an internal face (7), wherein said internal face has indentation patterns (8, 108), wherein each indentation pattern is substantially cylindrical about an axis, and wherein the axis of each indentation is substantially parallel to each other within a small offset angle, ($D_2$).

10. Bowl according to claim 9, wherein each indentation occupies a zone on said base surface (4) and each indentation pattern (8) on said internal face (7) projects, at least partially, from the zone occupied on said base surface (4) respectively by an indentation.

11. Bowl according to claim 9, wherein the patterns (108) are partitioned by radial dividers (109) on said internal face (7) of said bowl (1).

12. Bowl according to claim 9 comprising hemispheres (1*a*, 1*b*) having a pole (11) and comprising an equatorial plane (12), wherein the patterns (3, 103, 8) on said internal face (7) or said external face (2) of said bowl (1) or both have a cross section which decreases from said pole (11) of said hemispheres (1*a*, 1*b*) of said bowl (1) to said equatorial plane (12) of said bowl.

13. Bowl according to claim 2, wherein said external face (2) of said bowl (1) comprises sections of cylindrical surfaces (5) through said external face that are substantially equal.

14. Bowl according to claim 1 comprising hemispheres (1*a*, 1*b*) having a pole (11) and comprising an equatorial plane (12), wherein the patterns (3, 103, 8) on said internal face (7) or said external face (2) of said bowl (1) or both have a cross section which decreases from said pole (11) of said hemispheres (1*a*, 1*b*) of said bowl (1) to said equatorial plane (12) of said bowl.

15. Bowl according to claim 14 wherein said equatorial plane has an equatorial zone (12*a*, 12*b*) and wherein the poles (11) or the equatorial zone (12*a*, 12*b*) or both include(s) bosses (15) on said internal face (7).

16. Bowl according to claim 14 further containing an annular central slot (18*a*, 18*b*) in the wall of the hemispheres, located in the equatorial plane, and wherein said slot receives a centering ring (16).

17. Bowl according to claim 1, wherein said external face (2) of said bowl (1) comprises sections of cylindrical surfaces (5) through said external face that are substantially equal.

18. Bowl according to claim 1, wherein the indentations on said external face (2) of said bowl (1) have a trapezoidal shape and are distributed over said base surface (4) along lines of longitude (13) and lines of latitude (14) of the bowl (1), leaving spaces of constant width (f) between each trapezoidally-shaped indentation.

19. Process for obtaining a bowl for games of bowls, wherein said bowl comprises an external face (2) a base surface (4) and a relief pattern of a plurality of indentations (3, 103) having peaks and valleys wherein said peaks of said indentations are defined by said external face, and said valleys between said indentations are defined by said base surface, and wherein said relief pattern is uniformly distributed over at least 90% of said base surface (4) and wherein said indentations occupy a surface area that is at least 30% of said base surface (4); and wherein each indentation is substantially cylindrical about an axis, wherein the axis of each indentation being substantially parallel to each other within a small offset angle ($D_1$), for facilitating disengaging a tool during said process and wherein said bowl is hollow and further comprises an internal face (7), wherein said internal face has indentation patterns (8, 108), wherein each indentation pattern is substantially cylindrical about an axis, and wherein the axis of each indentation is substantially parallel to each other within a small offset angle, ($D_2$); which process comprises joining together two hemispherical shells obtained by forging or closed-die forging, employing a forging tool or closed-die forging tool and disengaging the tool and thereby obtaining said bowl.

20. Process for obtaining a bowl for games of bowls, wherein said bowl comprises an external face (2) a base surface (4) and a relief pattern of a plurality of indentations (3, 103) having peaks and valleys wherein said peaks of said indentations are defined by said external face, and said valleys between said indentations are defined by said base surface, and wherein said relief pattern is uniformly distributed over at least 90% of said base surface (4) and wherein said indentations occupy a surface area that is at least 30% of said base surface (4); and wherein each indentation is substantially cylindrical about an axis, wherein the axis of each indentation being substantially parallel to each other within a small offset angle ($D_1$), for facilitating disengaging a tool during said process and wherein said bowl is hollow and further comprises an internal face (7), wherein said internal face has indentation patterns (8, 108), wherein each indentation pattern is substantially cylindrical about an axis, and wherein the axis of each indentation is substantially parallel to each other within a small offset angle, ($D_2$); and wherein said process comprises joining together two hemispherical shells obtained by forging or closed-die forging, employing a forging tool or closed-die forging tool and disengaging the tool and thereby obtaining said bowl.

* * * * *